United States Patent [19]

Hashimoto

[11] Patent Number: 4,837,992

[45] Date of Patent: Jun. 13, 1989

[54] FOLDED/TELESCOPED DRILL RIG MAST FOR LIMITED SPACE PLATFORM

[75] Inventor: Tom T. Hashimoto, Conroe, Tex.

[73] Assignee: Branham Industries, Inc., Conroe, Tex.

[21] Appl. No.: 108,195

[22] Filed: Oct. 13, 1987

[51] Int. Cl.[4] ..... E04H 12/34

[52] U.S. Cl. ..... 52/118

[58] Field of Search ..... 52/116–120; 175/52, 85

[56] References Cited

U.S. PATENT DOCUMENTS

| | | | |
|---|---|---|---|
| 2,804,948 | 9/1957 | Woolslayer | 52/118 |
| 3,949,818 | 4/1976 | Russell | 175/52 |
| 4,366,650 | 1/1983 | Patterson | 52/118 |
| 4,371,046 | 2/1983 | Read | 52/116 |

*Primary Examiner*—John E. Murtagh

[57] ABSTRACT

A folding telescoped drill rig mast having wheel assemblies which travel along the power swivel guide rail to guide the telescoped upper mast as it retracts or extends within the lower mast. The fully extended upper mast locks into a transfer frame which moves laterally relative to the lower mast between a first position with the upper guide rail offset from the lower guide rail to a second position with the upper guide rail in longitudinal alignment with the lower guide rail. This lateral movement aligning the upper and lower masts enables pinning the upper and lower masts together to transfer the upper mast loading to the support members of the lower mast. The mast includes a base structure, a lower mast with a guide rail, and an upper mast held within the lower mast. The upper mast includes a guide rail for the power swivel. A dolly wheel assembly mounts to the upper mast and engages the lower guide rail to guide the upper mast as it travels between a first position within the lower mast to a second extended position. A transfer frame at the free end of the lower mast connects rigidly to the upper mast. The transfer frame and the upper mast are moved laterally relative to the lower mast to align the upper and lower masts and the upper and lower power swivel guide rails.

17 Claims, 6 Drawing Sheets

FOLDED/TELESCOPED DRILL RIG MAST FOR LIMITED SPACE PLATFORM

BACKGROUND OF THE INVENTION

The present invention relates to folded telescoped mast drilling rigs. More particularly, the present invention relates to a method and apparatus for erecting a folded lower mast and a telescoped upper mast to elevated operating positions on a drill platform, locking the upper mast to a transfer frame, and moving the transfer frame to a position to align upper and lower guide rails for the power swivel and to transfer the load of the upper mast to the lower mast support structure.

Various folded or telescoped mast drilling rigs may be used in either land or ocean based drilling operations. For desert or other land operations, the folded mast may be supported from a trailer truck for transporting the rig to the drill site. Typically, the folded mast section extends from its pivot point above the rear portion of the trailer towards the front end of the trailer.

There are various systems which may be employed to erect a lower mast and a pivotally connected upper mast to a vertical position. Hydraulic rams are commonly used to unfold the lower and upper masts together. In other systems a line reeved through sheaves on the mast sections connect to a drawworks which winds the line on a cable reel. Pulling the line pulls the mast into an erect operating position.

U.S. Pat. No. 3,295,270 issued to Woolslayer, et al. describes a two-section folded oil well mast structure. The back sides of the two sections hinge together permitting the upper mast to fold over the lower mast. In this apparatus the mast structure erects into a vertical operating position by winding a line onto a drawworks cable reel. The line extends along the lower mast and over the pivot hinge to a traveling block near the pivot point. A hook on the traveling block connects to a sling which connects between the lower and the upper mast sections. Winding the line on a cable reel moves the travelling block towards the front of the mast. The hook pulls on the fixed sling to swing the mast sections to an erect position.

U.S. Pat. No. 4,134,237 issued to Armstrong describes a modular section mast having telescoped modular mast sections which are inserted at remote land sites or on an offshore platform by a small capacity crane into the open side of the U-shaped lower mast. The uper mast is inserted and raised by cable in the erect lower mast. The intermediate mast is inserted and secured to the lower end of the upper mast. Removable retainer plates guide the upper and intermediate mast sections within the lower mast when being extended by pulling on a pulling line. After the mast is fully erected, the structures are bolted together.

U.S. Pat. No. 4,393,630 issued to Knox describes a truck mounted telescoping well mast structure which pivotally connects at its lower end to a truck. The mast structure folds over the truck from its pivotal connection at the rear of the truck. In raising the mast, the lower mast structure pivots from a horizontal position to a vertical position. The upper telescope structure then slides or moves upwardly on bearing pads permitting reciprocal travel of the upper structure relative to the lower structure. The upper mast may be extended and retracted by a hydraulic cylinder. A trolly having wheels moves along the inside edge of a vertical member of the lower mast section. The trolly is secured within a housing at the upper end of the lower section by an elongated track connected to the upper section. Securing the trolly locks a cable to allow the racking platform to extend.

U.S. Pat. No. 2,804,948 issued to Woolslayer, et al. describes a telescoping portable mast having two sections. The lower end of the mast is hinged so that the mast may swing to a horizontal reclining position. The legs of the upper mast have tongues which insert axially into forks on the lower mast. The legs then rigidly connect by splice pins. The legs of the lower section serve as guide rails for grooved wheels to support and guide the upper section when it extends or retracts.

U.S. Pat. No. 2,804,949 issued to Woolslayer, et al. describes a two-section telescoping portable mast hinged at its lower end to enable a mast to swing to a substantially horizontal position. The legs of the upper mast have tongues which insert axially into forks on the lower mast. The legs are rigidly connected by splice pins. A trolly roller suspended from the top of the lower section engages a rail extending longitudinally along the upper section. The roller and rail cooperate to guide the extension and retraction of the upper mast.

While folded and telescoped masts provide mobility and stability during transportation, these masts must be secured to withstnad the stresses of the mast. During drilling operations, the frame members for the mast sections must be aligned and secured by pinning or other means to transmit the loading on the mast to the mast support structure.

U.S. Pat. No. 2,336,432 issued to Wilson describes a two-section telescoped oil well mast having corner angle members that are aligned axially. These members laterally support and guide the upper mast section. After the telescoped mast is fully extended, the adjacent portions of the upper and lower mast sections are wedged together to secure the upper mast to the lower mast. It is of concern, however, that this wedging and locking is not able to withstand a significant backlash from the drilling operation. In that situation, the upper and lower sections of the mast may separate causing destruction of the mast and dangerous operating conditions for the drillers.

Some of these folded and telescoped masts also do not appear adapted to advantageously employ a power swivel for turning the drill string. The present invention enables a compact drill rig mast to use a power swivel for drilling operations. The power swivel is a relatively recent advance in drilling technology. Dolly wheels connected to the power swivel housing run on a pair of flanged guide rails to resist torque and to keep the power swivel aligned with the well centerline. Use of guide rails permits more rapid vertical movement of the traveling block which is suspended from the drawworks cable. A drill rig using a folded or a telescoped mast and a power swivel would have to align the power swivel guide rail in the various mast sections to permit drilling activity.

SUMMARY OF THE INVENTION

In accordance with the present invention there is disclosed a folded telescoped mast drilling system which addresses the disadvantages of drill masts known in the industry. The system of the present invention provides rail guided raising and lowering of the upper mast, alignment of the mast support members and the power swivel guide rail, and secure connection of the upper and lower masts for transferring the load from the mast to the mast support structure.

Apparatus constructed in accordance with the teachings of the present invention provide for the secure connecting of the upper and lower mast sections so that loads are transmitted safely from the mast to the mast support structure. Further, the raising and lowering of the upper mast is stabilized by dolly wheel assemblies traveling on the rails of the power swivel guide. This reduces the need for mast support members slideably contacting each other during the erection process, and thus minimizes unnecessary damage during assembly and disassembly of the mast. Once the upper mast is fully erected, it is locked into a transfer frame at the upper end of the lower mast. The transfer frame then moves laterally with respect to the lower mast from a first forward position to a second back position. This movement aligns the upper and lower guide rails for the power swivel. The upper and lower masts are then pinned together for added strength and stability of the erected operating drill mast.

Offshore platforms typically are floated to an ocean drill site and then anchored to the sea bottom. The base structure is installed and a conventional derrick assembled member-by-member at the drill site. Offshore platform installation is expensive, dangerous, and time consuming. Installing a derrick on an offshore platform involves relatively dangerous work for the crew performed at the ocean site over a several week or more period. A folded telescoped mast would reduce the assembly risks and time by enabling the mast to be assembled on land and barged to the anchored platform. A heavy crane on another barge may then hoist the mast to a substructure of the platform. The mast may then be quickly be connected to the substructure and erected. The compact folded, telescoped mast carried in a barge would have a low center of gravity which provides stability to the barge while traveling through the ocean to the drill site.

Because of the dangers and costs, conventional derricks may not be disassembled from the drill platform after the drilling is completed. The present invention may however be more easily removed. After the wells are drilled (and on offshore platforms, sometimes over 100 wells are drilled at one site) the mast may be telescoped and folded, disconnected from the substructure and hoisted by a crane to a barge for transportation to another platform.

The present invention comprises a drilling rig having a substructure; a lower mast which has a pivotally connected lower mast support section and an intermediate mast which folds from its pivotal connection with the lower section; an upper mast telescoped within the intermediate mast section; and a transfer frame at the upper end of the intermediate section for securing and aligning the upper mast to the lower mast. The lower and upper masts are each preferably U-shaped in cross-section. The open face of the lower mast permits the lower mast to receive the upper mast which is narrower in cross-section than is the lower mast.

When the drill rig reaches the drill site, the lower support section and the intermediate mast unfold into a vertical operating position. The lower mast support section and intermediate mast are pinned together to assemble securely the lower mast. A hydraulic ram or line reeved through sheaves to a draw works cable reel may be employed to unfold the intermediate mast section into a vertical position. A preferred embodiment of the present invention uses a hydraulic cylinder to erect the lower mast.

The upper mast is raised from its telescoped position within the intermediate mast. The telescoping movement of the upper mast is guided by dolly rollers which travel on the lower guide rail for the power swivel. When the upper mast reaches its fully extended position, the lower end of the upper mast is securely pinned to the transfer frame. The upper mast is offset with respect to the lower mast, and the transfer frame slides or moves laterally to align the upper and lower masts and effect a load transferring relation. Embodiments of the present invention use a motor connected to pinion gears to drive the transfer frame. In one embodiment, the motor is electric, while in another the motor is hydraulic. Still another embodiment uses a hydraulic cylinder to push and pull the transfer frame between positions. This lateral movement of the transfer frame also aligns the upper and lower rail for the power swivel guide. Once the upper and intermediate mast sections are aligned, the transfer frame is secured in place by appropriate means such as dog and pin locks.

The mast of the present invention requires a smaller platform area than the derricks typically erected on platform rigs. Generally, offshore platforms are crowded with crew housing and office facilities, cranes, equipment storage, pipe racks and pipe handling equipment, helicopter landing pads, and more. Thus, the folded telescoped mast disclosed herein will normally have less interference with these other objects on the crowded platform.

Further, an embodiment of this invention may be useful with older platforms which need work-over drilling on existing wells. For this application the folded telescoped mast would be barged to the drill platform and hoisted by a crane to the platform.

BRIEF DESCRIPTION OF THE DRAWINGS

Objects and advantages of the present invention will become further apparent upon reading the following detailed description and upon reference to the following drawings, in which like elements have like identifiers.

DESCRIPTION OF THE PREFERRED EMBODIMENTS

Figure 1:
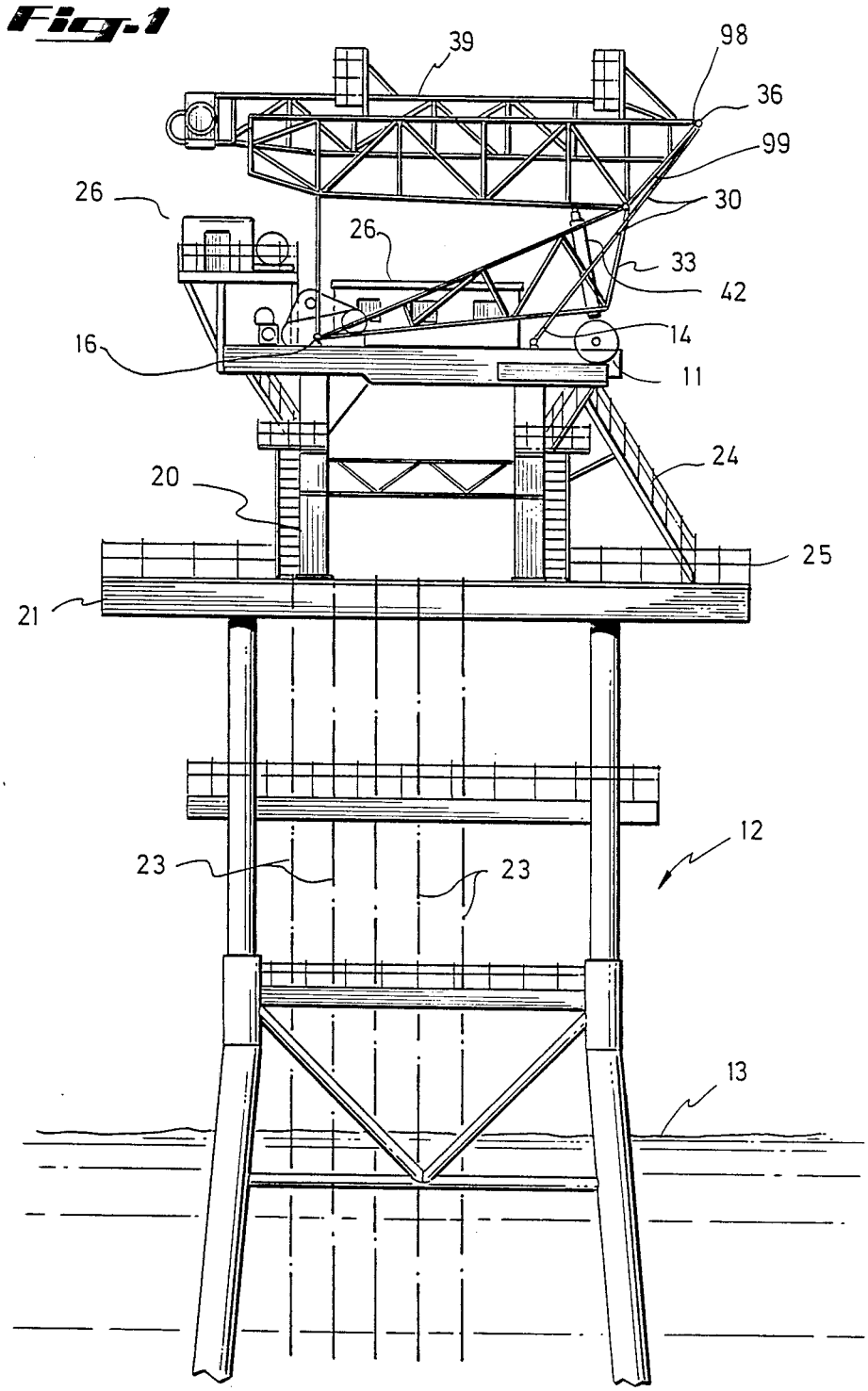
FIG. 1 is a side view of an offshore drill rig platform on which is mounted a folded, telescoped mast of the present invention.

The present invention enables use of a high rise drill rig mast on limited space drill sites, and particularly on limited space platforms typically used in offshore oil drilling activities. FIG. 1 illustrates a side view of a folding telescoping drill mast 10 of the present invention mounted on a limited area offshore platform 12 used to drill wells in the floor of the ocean 13. The mast 10 is mounted on the substructure 11 of the platform 12 at pivot points 14 and 16. A skidding structure 20 moves on rails and rollers (not illustrated) on the main deck 21 of the platform 12.

The skidding structure 20 permits relocating the drill mast 10 so that a plurality of wells may be drilled at the site. The vertical lines 23 illustrate various well center lines which may be drilled. The offshore platform includes a pipe ramp 24, railing 25 and control and equipment rooms 26. The folded telescoped drill mast 10 of the present invention includes a lower mast 30 which has a lower base or support structure 33 and a folded intermediate section 36. The intermediate section 36 is cantilevered to the base structure 33. The lower mast 30 is U-shaped in cross section and has one open face, which enables an upper mast 39 to nest in the intermediate mast section 36. A hydraulic jack 42 mounts between the base section 33 and the folded intermediate section 36. Hydraulic jack 42 is used to raise folded intermediate section 36 to the erect position depicted in FIG. 2A. During this erection process, leg 99, depicted in FIG. 1, rotates about pivot points 14 and 98 to the position shown in FIG. 2A.

Figure 2A:
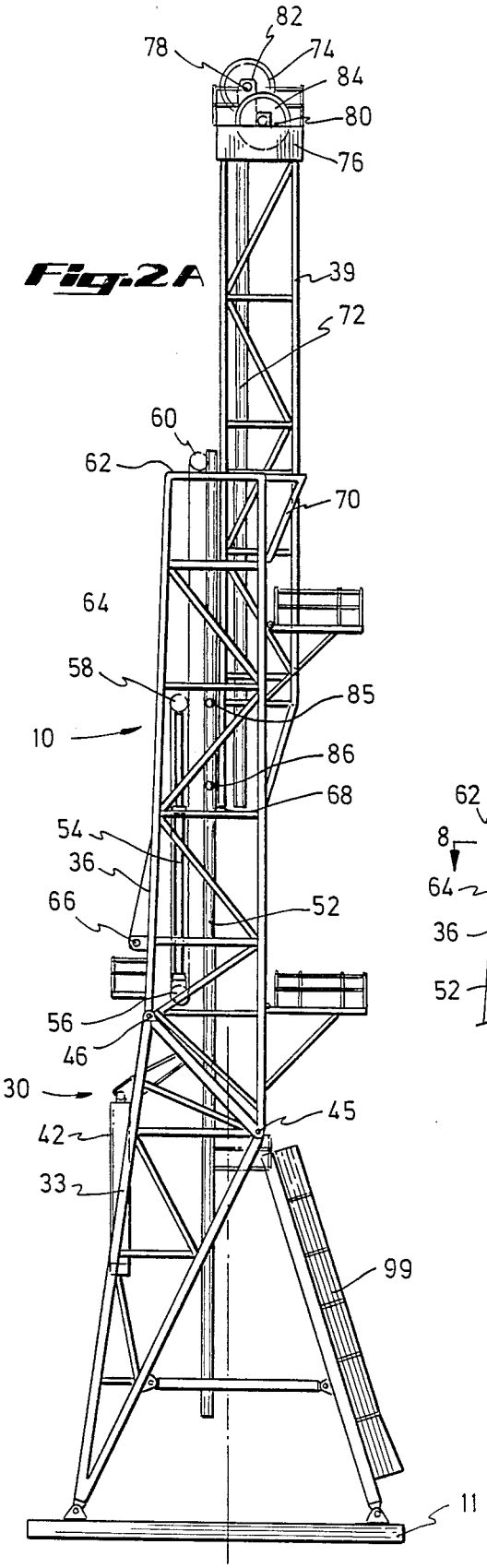
FIG. 2A illustrates an unfoled mast of the present invention with the upper mast section untelescoped outward between its lowest and highest extension.
Figure 2B:
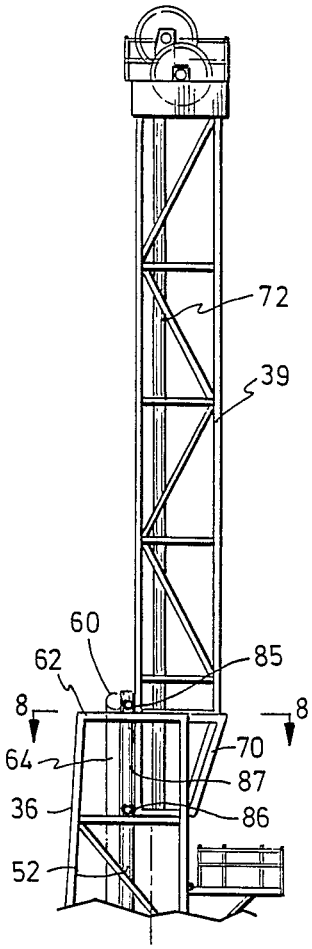
FIG. 2B is a cut away illustration of the unfolded mast in FIG. 2A where the upper mast section is fully extended so that the lower portion of the upper mast is adjacent the transfer frame and the upper portion of the lower mast section.
Figure 2C:
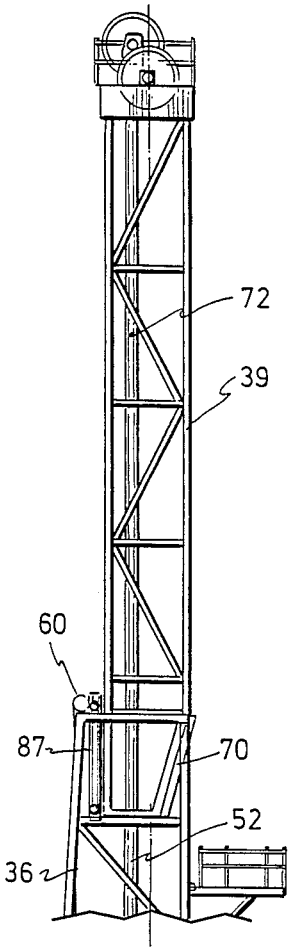
FIG. 2C is a cut away view of the unfolded mast of 2A where the upper mast section and the transfer frame have moved to a back position to align the upper and lower traveling block guide rails.

FIGS. 2A–C illustrate side views of a folded, telescope-type mast 10 unfolded and erected on the drill platform substructure 11. Referring especially to FIG. 2A, the base 33 and the intermediate section 36, after being erected using the hydraulic piston 42, connect at a pin 45 and a pin 46. The lower mast section 30 includes a lower power swivel guide rail 52. The guide rail is a wide flange steel member in which dolly wheels roll against the interior face of the flange. Typically two guide rails are positioned at the back of the mast equidistant laterally from the well centerline. The lower mast 30 also supports a hydraulic cylinder 54 having a lower guide roller or sheave 56 and an upper guide roller or sheave 58. An upper mast roller or sheave 60 connects to the upper beam 62 of the lower mast section 30. One end of a cable sling 64 is secured to a bolt 66 on the intermediate mast section 36. The cable 64 loops over the upper guide roller 58, down and around the lower guide roller 56, up and over the upper mast roller 60 and down to a bolt or tie down 68 on the bottom beam of the upper mast section 39.

Mounted to the upper end of the lower section 30 is a mast support frame 70. The support frame 70 defines a transfer frame which moves the upper mast 39 laterally with respect to the lower mast 30 to a longitudinally aligned drill rig operating postion. The upper mast section 39 includes an upper guide rail 72 for the power swivel. Traveling block pulleys 74 and 76 mount between upwardly extending flanges 78 and 80 on shafts 82 and 84 at the free upper end of the upper mast 39. Dolly roller assemblies 85 and 86 attach to the lower end of the upper mast section 39 and travel along the lower guide rail 52.

FIG. 2B is a cutaway view of the unfolded mast in FIG. 2A where the upper section 39 is fully vertically extended beyond the upper end of the lower mast, from its telescoped position so that the lower section of the upper mast 39 is adjacent the transfer frame 70. The dolly roller assemblies 85 and 86 ride in a guide rail 87 connected to the transfer frame 70. The guide rail 87 and 52 connect together to permit the dolly wheel assemblies 85 and 86 to roll from the lower guide rail 52 to the transfer frame guide rail 87. As illustrated, the lower end of the upper guide rail 72 is adjacent to and offset from the upper end of the lower guide rail 52. FIG. 2C however illustrates the extended vertically upper mast section 39 in a second, back position which places the power swivel upper guide rail 72 and the lower guide rail 52 in alignment. In this second position, the lower mast 30 is pinned to the upper mast. That connection enables transfer of the upper mast loading to the lower mast structural members.

The transfer frame 70 connects between the upper mast 39 and the upper end of lower mast 30. After the upper mast 39 telescopes from the lower mast 30, the lower end of the upper mast 39 rigidly connects to the transfer frame 70. The transfer frame 70, together with the upper mast 39, may then be moved from a first forward position (see FIG. 2B) to a second back position (see FIG. 2C) to align the upper and lower masts 39 and 30. Such movement aligns the upper and lower guide rails 72 and 52. Mounted on the transfer frame 70 are guide roller assemblies (not illustrated) to steady the upper mast 39 as it telescopes in and out of the lower mast 30. The lower mast 30 also includes roller asemblies (not illustrated) to steady the transfer frame 70 when it moves between the forward and back positions. Appropriate pin and dog coupling assemblies connect the three structures together rigidly.

To facilitate understanding the structures of the present invention, each of the lower mast 30, the transfer frame 70 and the upper mast 39 will be discussed separately with reference to the drawings. Particular emphasis will be placed on the structural members where the lower mast 30, the transfer frame 70 and the upper mast 39 connect together to permit the transfer frame 70 and the upper mast 39 to interlock and to move relative to the lower mast 30. Referring to FIGS. 3–13, elements of the lower mast 30 have identifiers beginning with 200; those of the transfer frame begin with 300; and those for the upper mast elements begin with 400. Considering first the lower mast 30, attention is directed to FIG. 8 which is a top view of the telescoping mast of the present invention taken through line 8—8 of FIG. 2B. The lower mast 30 has two side support members 201 at its top and a connecting back member 202 which extends between the back ends of the upper support members 201. The front side of the lower mast is open. A front rail 204 and a back rail 205 extend upwardly from the support member 201. A plate 207 rigidly connects to the upper surface of the member 201. A flange 208 extends from the plate 207 and a hydraulic cylinder 209 pins to the flange 208. A lateral movement guide roller assembly 211 rigidly connects to the exterior side of the member 201. The assembly 211 exends up and inwardly and terminates in a roller 213 secured between a pair of parallel flanges 215. The flanges 215 rigidly connect to a plate 217 on the side of the member 201.

Figure 7:
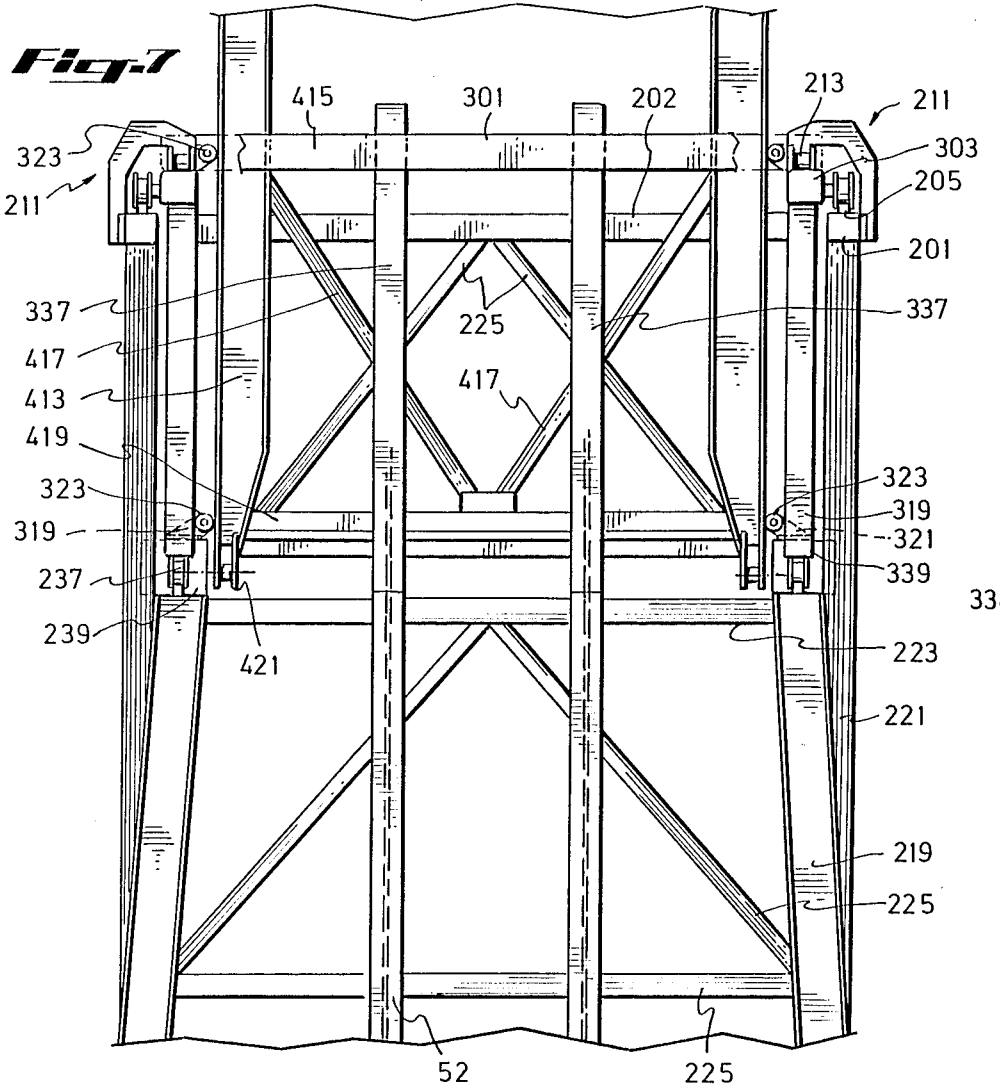
FIG. 7 is a front view of the transfer frame mounted at the upper end of the lower mast as illustrated in FIG. 4.

Turning now to FIG. 7, the lower mast section includes a front leg 219 and an outside support member 221 which extends upwardly adjacent to the transfer frame 70. The member 221 connects to the side member 201. FIG. 7 better illustrates how the roller assembly 211 extends up from the side of the member 201 and inwardly towards the transfer frame 70. Extending across the back of the lower mast 30 is the lower back member 223 as well as various lower mast structural support beams 225. The lower guide rail 52 extends longitudinally along the interior of the drill mast to the lower back member 223.

Figure 4:
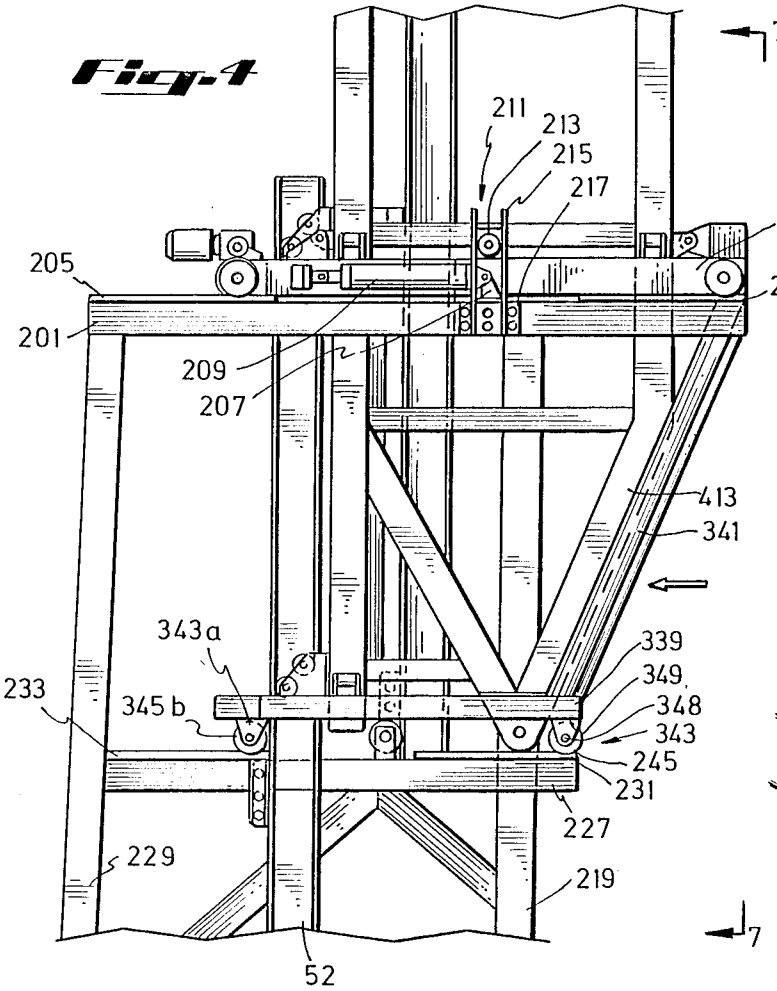
FIG. 4 is a side view, detailed illustration of the transfer frame mounted at the upper end of the lower mast adjacent the lower end of the upper mast.

FIG. 4 is a side view, detailed illustration of the transfer frame 70 which connects to the upper end of the lower mast 30. The roller assembly 211 connects through plate 217 to the support beam 201. The assembly 211 includes the parallel flanges 215 and the roller 213. Also illustrated in FIG. 4 is the lower side member 227 which extends between the front leg 219 and the back leg 229 of the lower mast 30. Extending upwardly from the upper face of the member 227 is a front rail 231 and a back rail 233. Again, the lower guide rail 52 for the power swivel extends up to the upper surface of the lower member 227. The roller assembly 211 extends over the flange 207 to which is pinned the hydraulic cylinder 209. A hydraulic pin 237 connects to a flange 239 (not illustrated) mounted between the ends of the lower member 227 and adjacent to the inner end of the rail 231. The hydraulic pin 237 extends through a second flange 241 (not illustrated) on the upper face of the member 227. The hydraulic pin 237 has a double actuated cylinder which allows the pin to be inserted and removed.

Attention is now directed to the structure of the transfer frame 70. The transfer frame 70 may be considered a substantially rectangular cage-like structure. Turning again to FIG. 8, the transfer frame 70 at its top has a front beam 301, parallel side rails 303 and a back member 305. On the interior side surface of the front beam 301 is a hydraulic power-driven pin assembly 307. The hydraulic pins 307 are double actuated enabling the pin to be inserted and removed. The pins preferably are taper-nosed which allows the pin to wedge through the flange bores and assist alignment of the connection. The assembly 307 mounts to a flange 311 and includes a hydraulic pin 309. A parallel flange 313 is spaced apart and is adjacent to the flange 311. Extending upwardly from the upper surface of the back member 305 are parallel flanges 315. Bolted to one of the flanges 315 is a hydraulically actuated pin 317. This pin 317 is similar to the pin 309. Four upper-mast guide roller assemblies 319 connect to the upper surface of the member 303. Each assembly 319 includes a pair of parallel flanges 321 and a roller 323 disposed between the flanges 321. Two assemblies 319 are one side of the mast; two are on the laterally opposite side.

Extending through the end of the front member 301 is a shaft 325 to which is rotatably connected a flanged wheel 327. The flanged wheel 327 rolls on the rail 204. Extending through the member 303 near its back end is a shaft 329. A flanged wheel 331 mounts to the shaft 329 and the flanged wheel 331 rides on the rail 205. The inner flange of the wheel 331 may include as illustrated a gear 328. The gear 328 engages a smaller drive gear 330 connected by a drive shaft 332 to a worm gear reducer 334. The worm gear 334 engages a drive motor 336. In one embodiment, the drive motor 336 is hydraulic while in another, the motor is electric. The drive shaft 332 is supported by bearings 338 mounted in flanges on the upper face of the back member. Extending outwardly from the exterior of the side member 303 is a flange 333. Pinned to the flange 333 is the piston 335 of the hydraulic cylinder 209. The hydraulic cylinder thus couples between the flange 333 of the transfer frame and the flange 207 on the lower mast member 201.

Turning now to FIG. 7, there is illustrated the power swivel guide rails 337 on the transfer frame 70. The rails 337 connect to the interior side of the back member 305. The upper mast guide roller assemblies 319 attach to the upper surfaces of the lower side member 339 and the upper side member 301. In a preferred embodiment, eight guide assemblies 319 are used: four per side with two on the upper member 301; two on the lower member 339.

A better view illustrating the lower transfer side members 339 is shown in FIG. 4. A side member 341 connects the front end of the lower side member 339 and the upper side member 303. Depending from the lower surface of the side members 339 are wheel assemblies 343. The wheel assembly 343 includes a flanged wheel 345 which rotates on a pin 347 secured between parallel flanges 349. The flanged wheel 345 rides on the rail 231. A wheel assembly 343*a* depends from the back end of the member 339. The flanged wheel 345*a* engages and rolls on the back rail 233.

Returning to FIG. 8, the upper mast 39 has two horizontal side beams 401. A flange 403 having a bore extends from the member 401 and may be engaged by the hydraulic pin 309. On the back side of the member 401 another flange 405 extends outwardly. That flange also contains a bore which may be engaged by the hydraulic pin 317. A back member 407 extends between the back ends of the parallel side members 401. Secured to the inner side face of the back member 407 is the upper guide rail 72. On the laterally opposite face is an upper mast dolly assembly 411.

FIG. 7 shows the legs 413 of the upper mast section. The rollers 323 of the upper mast guide roller assemblies 319 ride on the exterior faces of the legs 413. A back support member 415 extends between the parallel legs 413. Appropriate support members 417 connect the back member 415 with a lower back member 419.

Flanges 421 extend downwardly from the front legs 413. The flanges 421 include a bore through which the hydraulic pin 237 may extend.

Figure 5B:
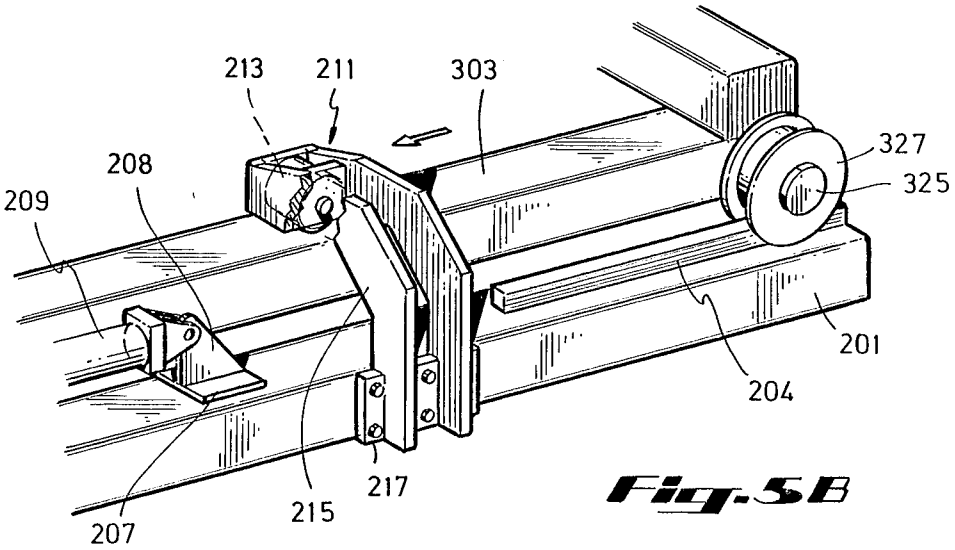
FIG. 5B is an orthographic side view of the front portion of the lower transfer frame member and its connection to the lower mast.
Figure 5A:
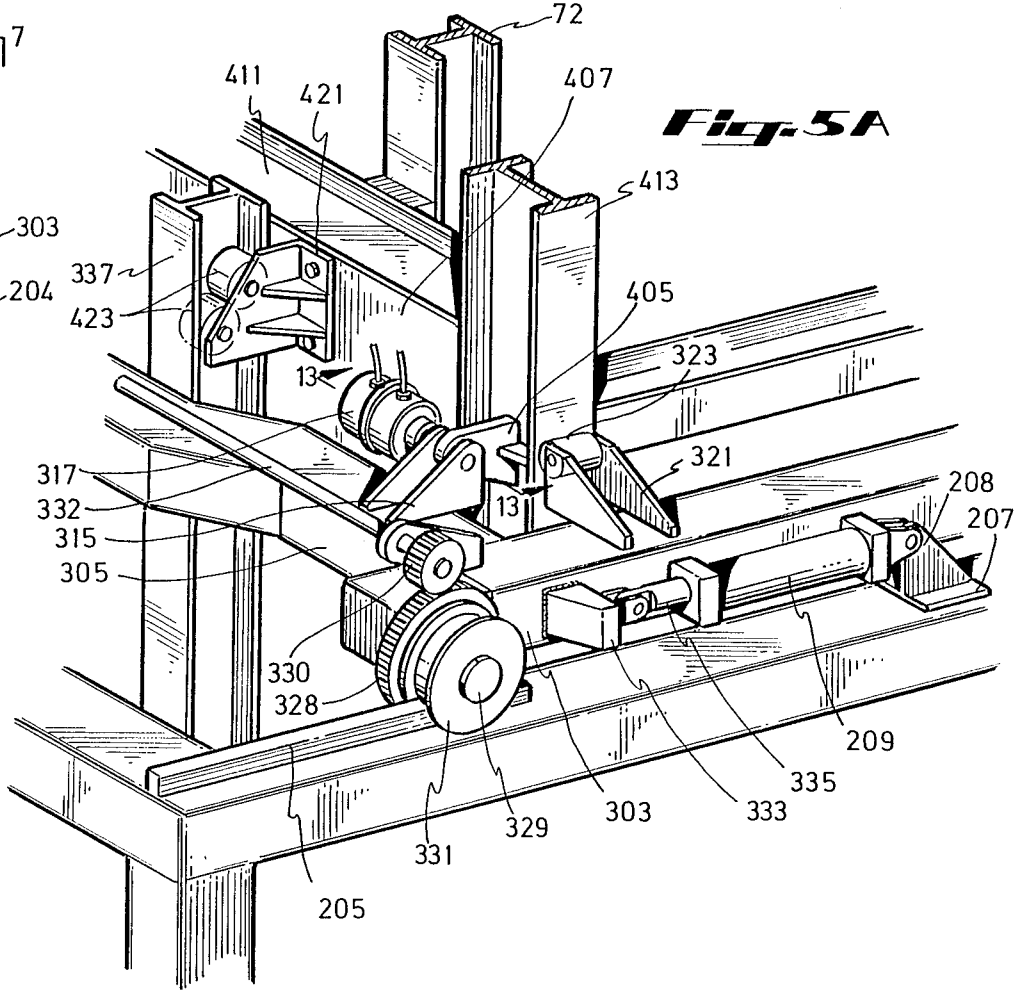
FIG. 5A is an orthographic view of the back and side of the transfer frame of the present invention adjacent the lower end of the upper mast.

With the above description of the structural members of the lower mast 30, the transfer frame 70, and the upper mast 39, attention is now directed to FIG. 5A which is an orthographic view of the back and a side of the transfer frame connections between the three structures discussed above. At the upper end of the lower mast 30 is the side member 201. Attached to the upper surface of the member 201 is the plate 207 and the flange 208 to which is pinned the hydraulic cylinder 209. The piston 335 of the cylinder 209 pins to the flange 333 extending from the exterior face of the transfer side member 303. The flanged wheel 331 rotatably mounted to the shaft 329 rides on the back rail 205 extending upwardly from the upper face of the member 201. Parallel flanges 321 mount to the upper face of the transfer frame side member 303. Pinned between the flanges 321 is the roller 323 which engages the exterior face of the vertical leg 413 of the upper mast 39. Extending from the back face of the leg 413 is the flange 405. The flange 405 inserts between the parallel flanges 315 on the upper face of the back member 305. The hydraulic pin 317 bolts to one of the flanges 315. Bores through the flanges 315 and 405 permit the hydraulic pin 317 to extend through the flanges 315 and 405 to rigidly couple the transfer frame 70 to the upper mast 39. FIG. 5A further provides an illustration of the dolly assembly 411. The dolly assembly 411 includes a flange 421 which rigidly couples to the back beam 407. The assembly 411 has a pair of wheels 423 which are preferably biased outwardly against the flanges of the guide rail in which the dolly 411 is engaged. In this illustration, the wheels 423 press against the flanges of the transfer frame guide rail 337. Double wheels reduce the play arising from the difference in the width of the guide rail.

FIG. 5B illustrates the connection of the transfer frame and lower mast structures at the front side of the mast. Extending upwardly from the lower mast member 201 is the rail 204. The flanged wheel 327 rotatably mounted on pin 325 engages the rail 204. The transfer frame roller guide assembly 211 mounts with the plate 217 to the exterior face of the member 201. Angled flanges 215 extend up and over the upper face of the member 201 and the upper face of the transfer member 303. Pinned at the upper end of the flange structure 215 is a roller 213 which engages the upper face of the member 303. The hydraulic cylinder 209 is pinned at its back end to the flange 208 which connects to the lower mast member 201 by the plate 207.

As noted earlier, FIG. 10 is a detailed partial view illustrating the connection between the upper guide rail 72 and the lower guide rail 52 for the power swivel. The guide rail 72 has a flange 511 extending perpendicularly from the back face at the lower end of the rail 72. A similar flange 513 extends from the back face at the upper end of the guide rail 52. The flanges 511 and 513 have a plurality of bores 515 along the longitudinal axis of the flanges. A plate 517 having similar bores may be installed on both sides of the flanges. The plate 517 preferably is U-shaped in cross-section to wedge into the flanges 511 and 513. Appropriate bolts, best illustrated in FIG. 11, extend through the bores in the plates 517 and the flanges 511 and 513. Securely bolting the flanges 511 and 513 together with the plate 517 and bolt 519 maintains the guide rails 72 and 52 in alignment and enhances the mast stability.

Figure 9:
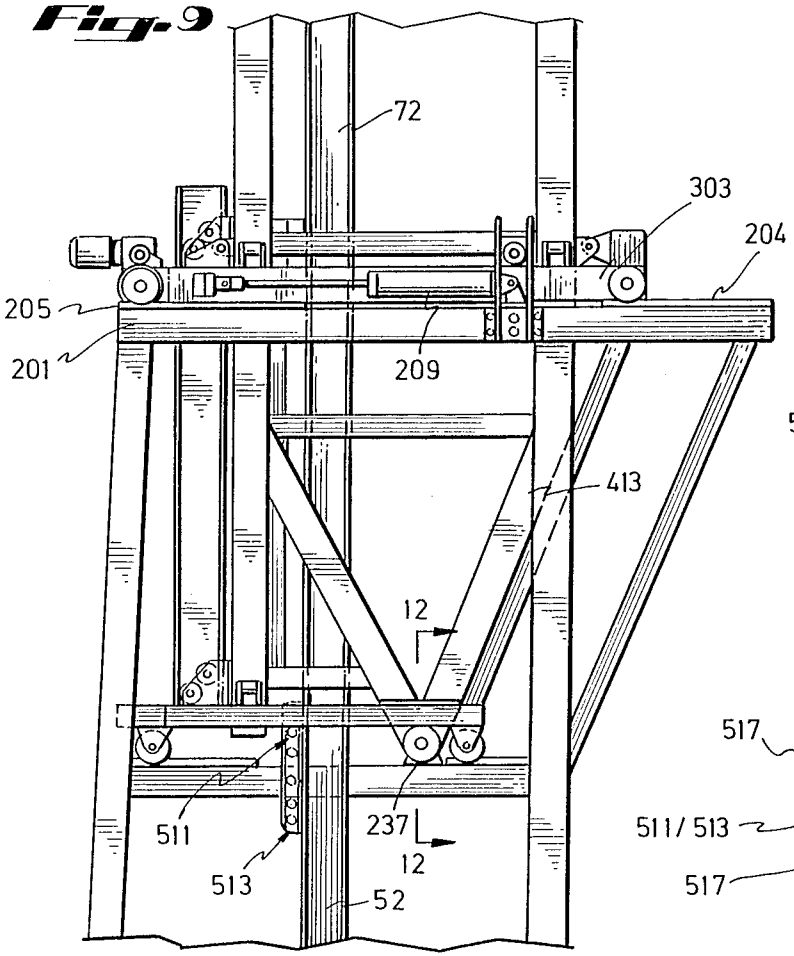
FIG. 9 is a detail illustration of the transfer frame moved to its back position to align the upper and lower masts.

FIG. 9 is a side view of the transfer frame portion of the mast of the present invention after the upper mast 39 has been fully extended, pinned to the transfer frame 70 and the transfer frame 70 moved from a first forward position to a second back position. The movement of the transfer frame 70 aligns the upper mast 39 with the lower mast 30 and in particular aligns the power swivel guide rails 72 and 52 of the drill mast. In this back position, the upper frame 39 may be coupled by the hydraulic pin 237 to the lower mast section 30. This pin coupling enables the upper mast loading to be transferred to the lower mast support structures. Also the guide rails 72 and 52 may be secured together by bolting the plate 517 to the back flanges 511 and 513 of the guide rails 72 and 52.

Figure 13:
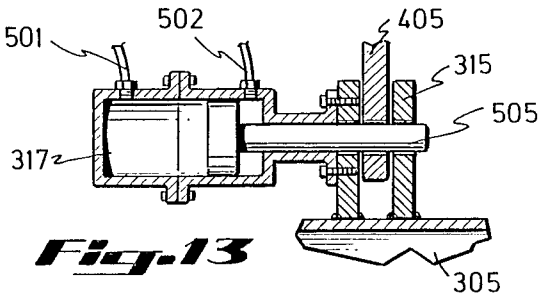
FIG. 13 is a cross section view of a hydraulic pin which secures the upper mast section to the transfer frame, taken along line 13—13 in FIG. 5A.

FIG. 13 provides a detailed illustration of the hydraulic pin 317 as illustrated in FIG. 5A. The hydraulic cylinder 317 is double acting and has hydraulic tubings 501 and 502 which connect to a source and controller of hydraulic fluid. The hydraulic cylinder is bolted to one of the parallel flanges 315 which rigidly connect to the upper face of the transfer frame back member 305. The flange 405 mounted to the back face of the leg 413 on the upper mast 39 extends between the parallel flanges 315. A pin 505 extends through the bores in the flanges 315 and 405 to rigidly connect the transfer frame 70 with the upper mast 39.

Figure 12:
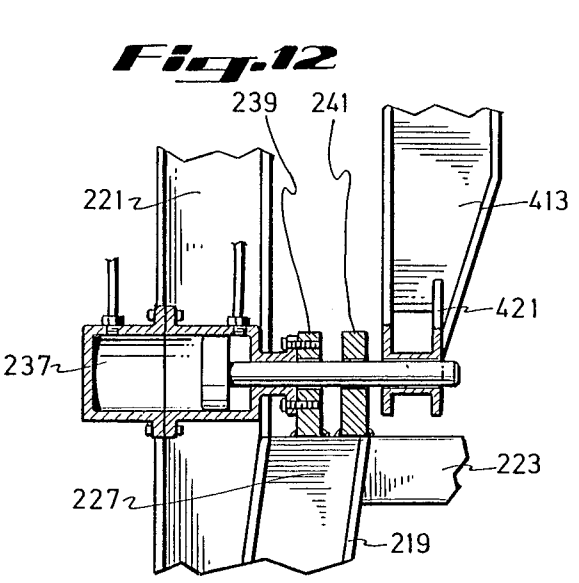
FIG. 12 is a detailed illustration of the hydraulic pin assembly which secures the upper mast section to the lower mast section, taken along line 12—12 in FIG. 9.

FIG. 12 is a detailed illustration taken along line 12—12 of FIG. 9 of the hydraulic pin 237 which couples the upper mast 39 to the lower mast 30. The pin 237 mounts to an outside flange 239 extending upwardly from the upper face of the member 227. A second flange 241 extends upwardly adjacent the flange 239. Flanges 421 depend from the lower end of the leg 413. The flanges 241, 239 and 421 each contain a bore through which the pin of the hydraulic cylinder 237 extends. The double flanges 239 and 241 provide a stronger connection with the flanges 421 than would a single flange supporting the hydraulic pin 237. A similar pin 237 and flange connection 239, 241 and 421 is on the laterally opposite side of the mast as illustrated in FIG. 7. This connection enables the loading on the upper mast to be transferred to the lower mast.

Figure 6:
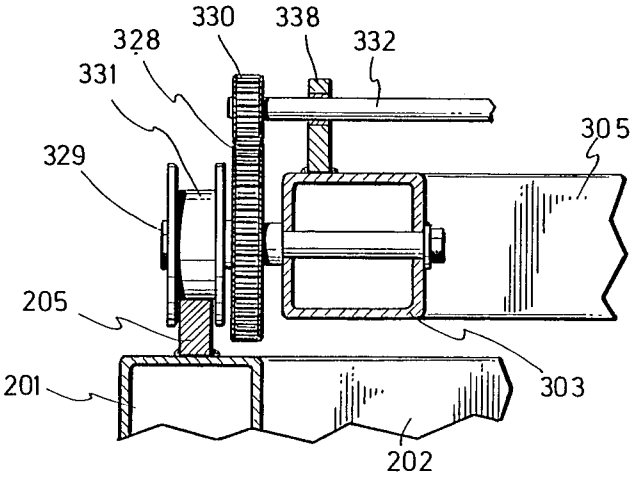
FIG. 6 is a cross section detail view of an upper wheel on the transfer frame, which connects to the upper support member of the lower mast and the drive wheel to move the transfer frame laterally.

FIG. 6 provides a detailed cut away view of an alternate drive for the transfer frame. The flanged wheel 331 rotatably mounts to a shaft 329 which connects to the transfer frame side member 303 adjacent to the transfer frame back member 305. The flanged wheel 331 engages the back rail 205 which extends upwardly from the lower mast side member 201. As also illustrated in FIG. 5A, the wheel 331 has a gear 328 which engages the pinion gear 330. The gear 330 is driven by the shaft 332.

Figure 3:
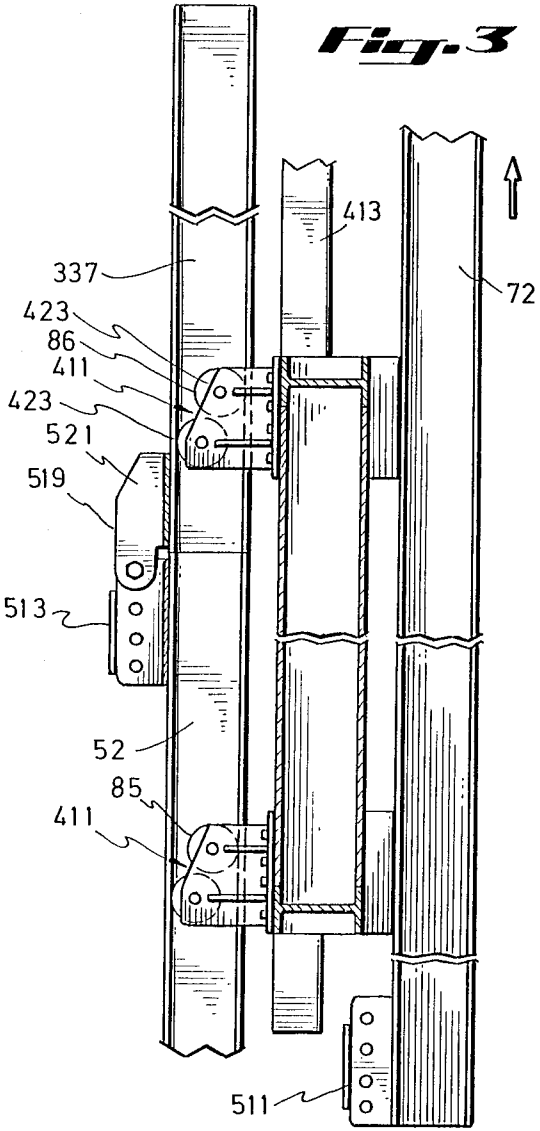
FIG. 3 is a cut away view of the dolly rollers secured to the lower portion of the upper mast to guide the upper mast as it extends and retracts relative to the lower mast.

FIG. 3 illustrates the transfer frame guide rail 337 coupled to the lower mast guide rail 52. The upper mast guide rail 72 is interconnected through the wheel assemblies 411. A flange 521 extends from the lower end of the guide rail 337 on its back face. The lower end of the flange 521 has a bore which accepts a bolt. The flange 521 interconnects with the flange 513 of the lower mast guide rail 52 by a bolt 519. The lower and the upper dolly assembly 411 are positioned on both sides of the guide rails 337 and 52. The wheels 423 of the assemblies 411 are preferably biased outwardly against the flanges of the guide rails. Double wheels are gainfully employed to reduce the amount of play in the width of the wide flange members 337, 52 and 72. In a preferred embodiment, the wheel assemblies 411 have a double set of wheels on both sides of the guide rails.

As illustrated in FIG. 1, the limited area offshore platform 12 having a limited amount of area on which to install a crane, housing and offices, a drill mast, and other drill rig items used to drill wells in the floor of the ocean 13 is floated to the drill site. The folded drill mast 10 of the present invention may be mounted to the substructure 11 before the platform 12 moves to the ocean site. The platform with the folded telescoped mast is stable while floating to the drill site because the compact folded mast of the present invention has a low center of gravity. More typically the platform may first be floated to the drill site and anchored to the sea bottom. The mast may then be barged to the site and hoisted to the substructure 11 by a crane. The mast 10 is pivotally connected to the substructure 11. The pivot points 14 and 16 permit the lower section 33 and the intermediate section of the lower mast 30 to elevate into an erect position. In this regard, there are various methods which may be used to elevate or lower folded masts; the illustrated embodiment in FIG. 1 uses a hydraulic jack 42 coupled between the lower base section 33 and the intermediate section 36 to unfold the lower mast 30. After the lower mast is erected, the base 33 and intermediate section 36 are rigidly connected at the pin 45 and the pin 46.

The upper mast 39 may then be erected. The upper mast 39 cradles in the U-shaped lower mast, and connects to the lower guide rail 52 by dolly assemblies 85 and 86. As illustrated in FIG. 2A, the cable sling 64 is secured to the bolt 66 on the intermediate mast section 36. The cable 64 cooperates with the hydraulic cylinder 54 supported in the lower mast 30 to extend the upper mast (or retract it if the mast is being disassembled). The cable 64 loops over the upper guide roller 58 which is connected to the piston of the hydraulic cylinder 54. The cable 64 then loops downward under the lower guide roller 56 at the fixed end of the hydraulic cylinder 54. The cable 64 threads up and over the upper mast roller 60 connected at the upper end 62 of the lower mast 30. The cable 64 finally secures to a bolt 68 on the bottom beam of the upper mast section 39 below the dolly assembly 86.

Activation of the hydraulic cylinder 54 extends the piston from the cylinder 54. The line 64 being elevated by the piston roller 58 pulls the upper mast 39 upward. As illustrated in FIGS. 2A and 3, the dolly assemblies 85 and 86 travel in the lower guide rail 52 to guide and to stabilize the upper mast 39. FIGS. 5A and 7 show that the upper mast guide rollers 323 connected by the flange 321 to the upper face of the transfer frame side members 303 also guide and steady the upper mast 39 as it telescopes from the lower mast 30. As best illustrated in FIG. 7, the eight guide rollers 323 roll on the exterior face of the upper mast legs 413.

Figure 8:
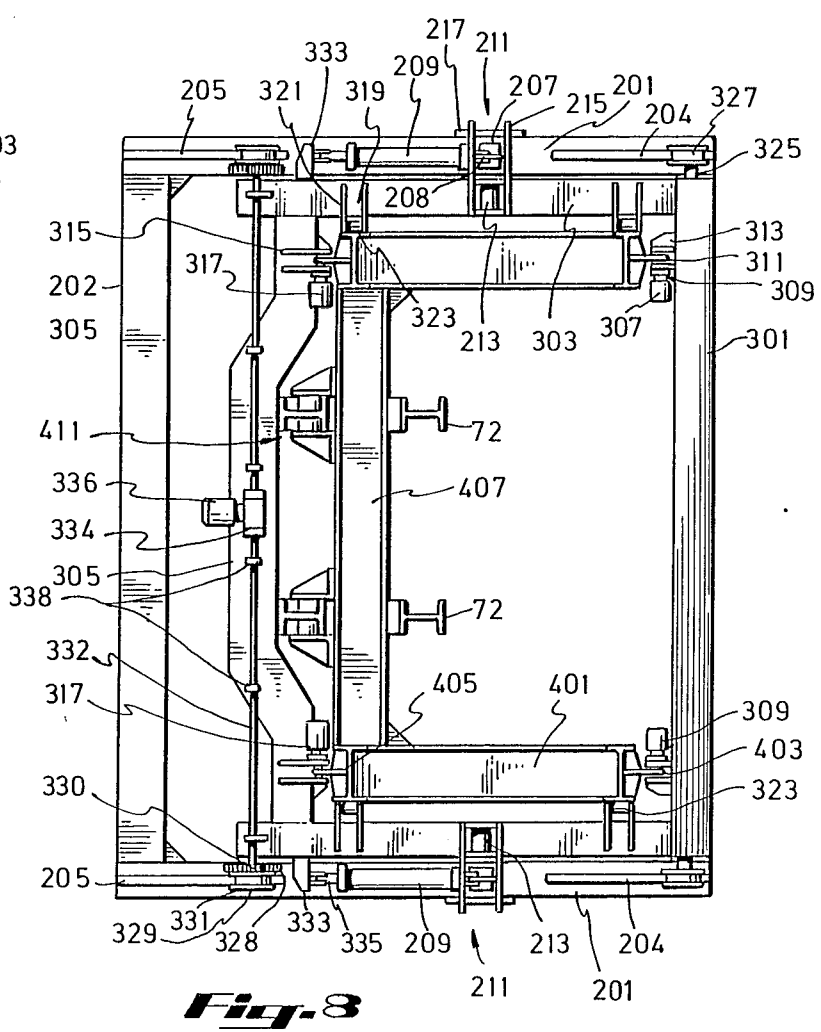
FIG. 8 is a top view of the upper end of the transfer frame taken along lines 8—8 of FIG. 2B.

Once the upper mast 39 is in its fully extended position as illustrated in FIG. 2B, the upper mast is pinned to the transfer frame 70. The hydraulic pin assemblies 307 and 317 are activated, and taper nose pins from these assemblies extend through bores in the flanges 311, 313, 315 and 405 as illustrated in FIG. 8 to rigidly connect the upper mast to the transfer frame. These four hydraulic pins are located at the corners of the transfer frame 70. The dolly rollers 85 and 86 after traveling up the guide rail 52 move on the guide rail 337 of the transfer frame 70. The guide rail 337 is similar to the upper guide rail 72 and the lower guide rail 52. As illustrated in FIG. 3, the guide rail 337 is bolted to the lower guide rail 52 prior to extending the upper mast. A bolt 519 connects the flanges 521 and 513 which extend from the back of the guide rails 337 and 52.

After the upper mast is fully extended, the upper mast is pinned to the transfer frame as explained above. The transfer frame guide rail 337 illustrated in FIG. 3 is disconnected from the flange 513 of the lower guide rail 52 by removing the bolt 519.

The transfer frame 70 is then ready to move with the upper mast 39 from the forward position to a back position. The lateral movement with respect to the lower mast 30 longitudinally aligns the rail 72 with the lower guide rail 52. Such alignment also positions the support legs 219 and 413 so that the upper mast load is carried by the framing legs of the mast.

FIG. 8 illustrates two different systems to move the transfer frame 70 from its forward position to the back position. One involves use of the hydraulic piston 209 connected by the flange 208 to the upper face of the lower mast member 201. The piston 335 of the hydraulic cylinder 209 pins to a flange 333 projecting from the side face of the transfer frame member 303. Activation of the hydraulic cylinder 209 pushes against the flange 333 and moves the transfer frame rearward. The flanged wheels 327 and 331 on the upper transfer frame member 303 roll on rails 204 and 205. The flange wheel assemblies 343 depending from the lower transfer frame member 339 roll on rails 231 and 233.

As illustrated in FIG. 5B, the transfer frame guide roller assembly 211 stabilizes the transfer frame 70 as the transfer frame 70 with the extended upper mast 39 moves from one position to the other. The roller 213 of the assembly 211 rolls on the upper face of the transfer frame member 303.

FIG. 8 also provides a top view of a second system to move the transfer frame 70. The flanged wheel 331 connects on its inner face to a gear 328. The gear 328 engages a drive gear 330 which connects by a drive shaft 332 through a worm gear reducer 334 to a drive motor 336. The various wheel assemblies 327, 331, and 343 discussed above permit the transfer frame to roll on the rails 204, 205, 231, and 233 from one position to another as illustrated in FIG. 4. Alternate embodiments of the present invention may use other structures or systems to move the transfer frame between positions. A more preferred embodiment, however, employs the hydraulic cylinder 209 to push and pull the transfer frame 70 between positions.

Once the transfer frame is moved to the back position as illustrated in FIG. 2C, the upper mast 39 is pinned to the lower mast 30. The hydraulic cylinder 237 pushes a pin through the flange 239 connected to the upper face of the member 227. The pin extends to the flanges 421 which depend from the leg 413 of the upper mast 39. Securely pinning the upper mast 39 to the lower mast 30 enables transferring the upper mast load to the support structure of the lower mast 30.

Figure 10:
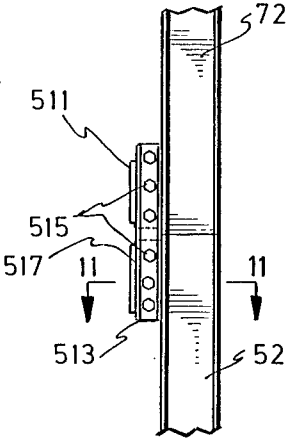
FIG. 10 is a detail illustration of the connection between the upper and lower guide rail for the power swivel.
Figure 11:
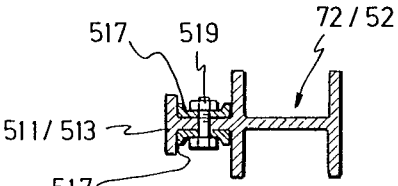
FIG. 11 is a cross section view of the bolt and plate which connects the upper and lower guide rails illustrated in FIG. 10 and taken along lines 11—11 of FIG. 10.

Finally, the upper guide rail 72 and the lower guide rail 52 are securely bolted together. As illustrated in FIGS. 10 and 11, plates 517 are placed on both sides over the adjoining flanges 511 and 513 which extend from the backs of the rails 72 and 52. Appropriate bolts 519 extend through the bores 515 and rigidly connect the flanges 511 and 513 together.

Thus, the present invention provides a folded telescoped drill mast which employs power swivel technology to drive the drill string, without sacrificing the cost effective derrick heights typically used on offshore drilling platforms. These mast heights on typical rigs reach heights of 160 or more feet which is sufficient for three lengths of drill pipe between the drill floor of the substructure 11 and the power swivel. A lower rail 52 guides and helps stabilize the upper mast 39 as it telescopes in or out of the lower mast 30. Once the upper mast 39 is fully erected, the upper mast 39 is pinned to the transfer frame 70 which moves the upper mast 39 laterally to align an upper guide rail 72 with the lower rail 52. When such alignment occurs, the structural support legs of the upper mast 39 and the lower mast 30 cooperate to support the structural load on the mast during drilling operations.

To lower the mast, the process is reversed. The upper rail 72 is disconnected from the lower rail 52 by removing the bolts 519 which secure the plate 517 to the adjoining flanges 511 and 513. The lower mast pins 237 are retracted to disconnect the upper mast 39 from the lower mast 30. The transfer frame moves from its back position to the forward position. In one embodiment, the transfer frame is moved by retracting the hydraulic cylinder 209. In another embodiment, the motor 336 turns the drive shaft 332 which drives pinion 330 against the gear 328. In both embodiments, the wheels 327, 331 and 243 roll on the rails 204, 205, 231 and 233. The transfer frame moves forward to align the transfer frame guide rail 337 with the lower guide rail 52. As illustrated in FIG. 3, the upper guide rail 337 may be rigidly connected to the flange 513 of the lower guide rail 52.

With the guide rail 337 bolted to the lower guide rail 52, the upper mast 39 is released from its connections with the transfer frame 70. The pins in the hydraulic pin assemblies 307 and 317 are retracted from the bores of the connecting flanges 311, 313, 315 and 405 as illustrated in FIG. 8. The hydraulic cylinder 54 then retracts. The cable 64 weaved through rollers 56, 58, and 60 and securely coupled at its end to the lower mast by a bolt 66 and to the upper mast by a bolt 68 cooperates with the cylinder 54 to retract the upper mast 39 into the lower mast 30.

With the upper mast 39 fully retracted into the lower mast 30, pins 45 and 46 are removed. The hydraulic cylinder 42 then operates to unfold or collapse the lower section 33 around a pivot point to fold the intermediate section 36 over the lower section 33. The mast may then be disconnected from the substructure, lifted by a crane to a barge, and transported to another drill platform.

The principles, preferred embodiments and modes of operation of the present invention have been described in the foregoing specification. The invention is not to be construed as limited to the particular forms disclosed, since these are regarded as illustrative rather than restrictive. Moreover, variations and changes may be made by those skilled in the art without departing from the spirit of the invention as described by the following claims.

What is claimed is:

1. A folding, telescoping drill rig mast, comprising:

a base structure;

a lower mast including a lower support section pivotally connected to the base structure and an intermediate mast section cantilevered to the lower support section and rotatable from a first horizontal position to a second vertical position;

a lower guide rail extending longitudinally through the intermediate mast section;

an upper mast slideably nested within the intermediate mast section;

an upper guide rail included within said upper mast;

a dolly mounted on the upper mast to engage the lower guide rail to guide the upper mast vertically from a first position within the lower mast to a second position extending vertically beyond the upper end of the lower mast; and a transfer frame at the upper end of the lower mast, in which the upper mast is secured, and moveable laterally relative to the lower mast between a first position with the upper guide rail offset from the lower guide rail to a second position with the upper guide rail in longitudinal alignment with the lower guide rail.

2. A folding, telescoping drill rig mast as recited in claim 1, further comprising:

a pair of horizontally disposed rails at the free end of the intermediate mast section, and a wheel with flanges to roll on each rail for rolling the transfer frame from the first position to the second position.

3. A folding, telescoping drill rig mast as recited in claim 1, wherein the guide rail has a flange.

4. A folding, telescoping drill rig mst as recited in claim 3, wherein the dolly further comprises:

a pair of flanges extending from the back of the upper mast; and at least one wheel rotatably mounted on a shaft between the flanges, the wheel to engage the guide rail.

5. A folding, telescoping drill rig mast as recited in claim 4, wherein the wheel is biased against a flange of the guide rail.

6. A folding, telescoping drill rig mast as recited in claim 4, wherein the dolly has two wheels.

7. A folding, telescoping drill rig mast as recited in claim 6, wherein the wheels are oppositely biased against flanges.

8. A folding, telescoping drill rig mast as recited in claim 3, wherein the dolly has at least one wheel on each side of the flanged guide rail.

9. A folding, telescoping drill rig mast as recited in claim 1, further comprising means to guide the transfer frame as it moves between the first and second position.

10. A folding, telescoping drill rig mast as recited in claim 9, wherein the guide means comprises:

a flange member connected to the free end of the lower mast extending upward and inwardly towards the transfer frame; and a roller rotatably mounted on a shaft connected to the flange member, the wheel to engage the transfer frame.

11. A folding, telescoping drill rig mast as recited in claim 1, further comprising means to steady and guide the upper mast as it extends or retracts from the lower mast.

12. A folding, telescoping drill rig mast as recited in claim 11, wherein the guide means comprises:

a pair of flanges connected to the transfer frame; and a roller rotatably mounted on a shaft between the flanges, the wheel to engage the upper mast.

13. A folding, telescoping drill rig mast as recited in claim 1, further comprising a power swivel mounted on the guide rail.

14. A foldable, telescoping drill rig comprising:

a base;

a first mast section pivotally mounted at a first end to the base and adapted to pivot between a laterally disposed folded position and a vertically disposed, unfolded position;

a second mast section pivotally mounted at a first end to the second end of the first mast section and adapted to pivot between a folded position along side the first mast section and an unfolded position extending from the second end of the first mast section in longitudinal alignment with the first mast section;

a third mast section mounted within the second mast section in longitudinally telescoping relation and adapted to move vertically between a retracted position within the second mast section and an extended position projecting vertically from the second end of second mast section; and a mast support member mounted at the upper end of the second mast section in laterally movable relation with the second mast member and configured to support the third mast section from the second mast section, said mast support member adapted to be moved laterally with the third mast section relative to the second mast section between a first position in which the third mast section is in longitudinal alignment with the second mast section and a second position in which the second and third mast sections are parallel but offset.

15. The drilling rig of claim 14, further comprising:

a power swivel mounted within one of the mast sections when the mast sections are folded and retracted and movable longitudinally within all three sections when the three mast sections are unfolded and projected and in longitudinal alignment.

16. A foldable, telescoping drill rig, comprising:

a base;

a first mast section pivoted at a first end to the base to swing around such pivot between a folded, laterally disposed position and an unfolded, vertically disposed position;

a second mast section pivoted at a first end to the second end of the first mast section to swing around the second end of the first mast section between a folded position alongside the first mast and an unfolded position extending from the second end of the first mast section in longitudinal alignment;

a third mast section adapted to fit within the second mast section in longitudinally telescoping relation between a retracted vertical position in the second mast section and an extended vertical position projecting beyond the second end of the second mast section;

a separate set of guide rails in each mast section configured to transport a power swivel along the each said section, the sets of guide rails in the first and second mast sections positioned to be in automatic alignment when these two mast sections are unfolded and vertically disposed;

the set of guide rails in the third mast section being alignable with the set of guide rails in the second mast section when the third mast section is in its extended position.

17. The drilling rig of claim 16 including a power swivel mounted on a set of said guide rails.

* * * * *